United States Patent [19]

Friedman et al.

[11] 4,165,951

[45] Aug. 28, 1979

[54] WATER PRESSURE BOOSTER SYSTEM AND CONTROL VALVE THEREFOR

[75] Inventors: Yizhak Friedman, Newton; Bernard B. Becker, Belmont, both of Mass.

[73] Assignee: Amtrol Incorporated, West Warwick, R.I.

[21] Appl. No.: 811,717

[22] Filed: Jun. 30, 1977

[51] Int. Cl.[2] ..... F16K 31/12; F04B 49/02; F04B 49/08

[52] U.S. Cl. ..... 417/26; 137/489; 137/491

[58] Field of Search ..... 417/38, 26, 44, 83; 137/489, 490, 491, 599.2

[56] References Cited

U.S. PATENT DOCUMENTS

| | | | |
|---|---|---|---|
| 2,360,816 | 10/1944 | Pasco | 137/489 |
| 2,563,889 | 8/1951 | Tuttle | 137/489 |
| 2,761,389 | 9/1956 | Turwal | 417/83 |
| 2,975,803 | 3/1961 | Vallee | 137/599.2 |
| 3,141,475 | 7/1964 | Guinard et al. | 417/44 |
| 3,399,696 | 9/1968 | Shaw | 137/489 |
| 3,613,716 | 10/1971 | Hoheisel | 137/491 |
| 3,669,143 | 6/1972 | Reese | 137/489 |
| 3,694,105 | 9/1972 | Martin | 417/26 |
| 3,703,911 | 11/1972 | Horihirl | 137/491 |
| 3,871,792 | 3/1975 | Gritz | 417/38 |
| 3,876,336 | 4/1975 | Nash | 417/38 |
| 3,922,111 | 11/1975 | Deters | 417/38 |

FOREIGN PATENT DOCUMENTS

| | | | |
|---|---|---|---|
| 1293034 | 4/1969 | Fed. Rep. of Germany | 137/599.2 |
| 868263 | 12/1941 | France | 417/489 |

*Primary Examiner*—William L. Freeh
*Attorney, Agent, or Firm*—Fisher, Christen & Sabol

[57] ABSTRACT

A water pressure booster system is disclosed having a control device which regulates the pressure in the distribution system via a closely balanced piston valve. Flow into the system from a pump is controlled by a throttling valve which is actuated by the pressure differential between the system pressure and a constant pressure acting on a closely balanced piston. Flow from the system back into the pump is prevented by a flow control/check valve within the throttling valve.

21 Claims, 7 Drawing Figures

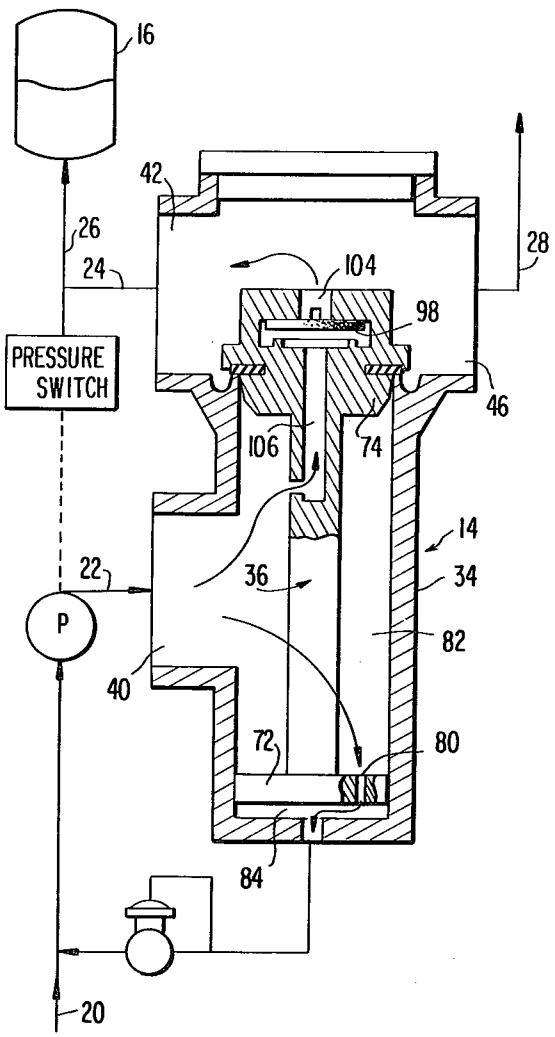
FIG. 4
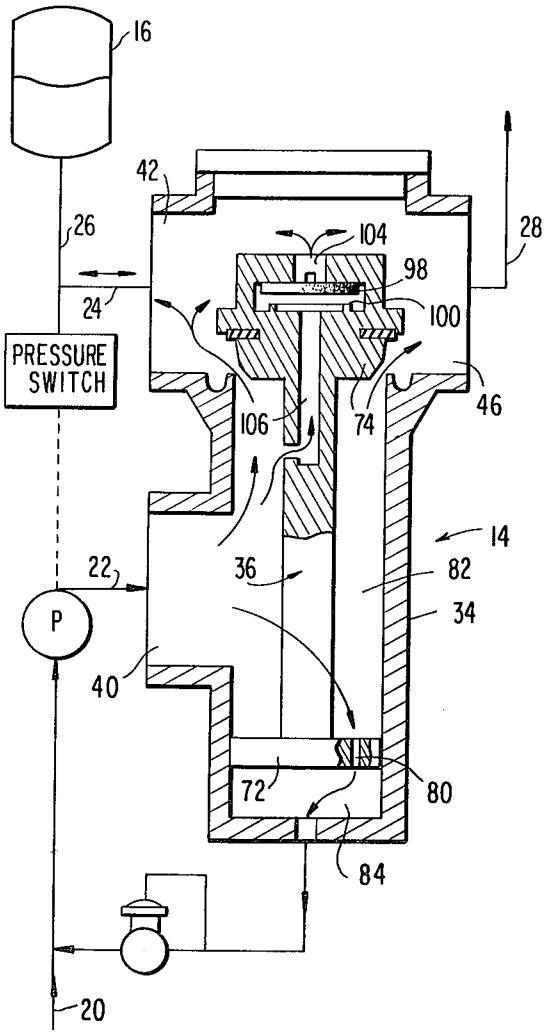
FIG. 5
FIG. 6

WATER PRESSURE BOOSTER SYSTEM AND CONTROL VALVE THEREFOR

FIELD OF THE INVENTION

This invention relates to water pressure booster systems and, more particularly, to a control valve for such systems.

BRIEF DESCRIPTION OF THE PRIOR ART

Water pressure booster systems are well known, and generally serve to maintain adequate water pressure in tall buildings or in smaller buildings located in areas which have inadequate or antiquated municipal water supply systems. These systems operate to "boost" the water pressure inside an individual building when the pressure drops to a point below which it becomes impossible to achieve normal water usage.

Typical prior art booster systems have included a motor driven pump connected to a water supply source, such as a well or municipal supply system, a control valve to regulate a pressure actuated switch to switch the pump motor on and off in dependence of the buildings water pressure. The aforedescribed system meets the basic requirements of a booster system, however, it results in frequent on-off cycling of the motor and pump, since any opening of a faucet would reduce the pressure in the system enough to turn on the pump.

To alleviate this problem, it is known to provide an accumulator tank in the system. This tank provides water to the system for relatively small amounts drawn off by opening the service faucets without the necessity of turning on the pump and motor. However, the inclusion of such a tank in the system renders the function of the control valve more difficult, since it must allow the motor and pump to continue to run after the service faucet has been shut off to replace the water drawn from the accumulator tank. The following U.S. Patents describe water pressure booster systems utilizing the aforementioned concepts: U.S. Pat. Nos. 3,739,810; 3,782,858; 3,814,543; 3,865,512; 3,871,792; 3,876,336; and 3,922,111.

The prior art booster systems have generally utilized a diaphragm actuated valve to regulate the pressure in the system and to control the refilling of the accumulator tank. Some of the prior art use a pilot pressure in conjunction with the diaphragm to control the position of the valve, while others use biasing means, such as a spring or pneumatic pressure.

The diaphragm in such control valves is subject to failure both through rupture and through ineffective sealing about its periphery. Also, in those systems which use biasing means along with the diaphragm the biasing means must exert sufficient force on the valve member to overcome any frictional forces to insure closing of the valve. This obviously increases the force necessary to open the valve and, consequently, increases the pressure drop through the control valve.

The prior art systems which use a pilot pressure to control the main valve position usually require an additional regulator to regulate the pilot pressure and a separate check valve to prevent the accumulator from discharging back through the pump. This results in a booster system which is unnecessarily complex and usually entails increased maintenance and increased chances of system malfunction.

SUMMARY OF THE INVENTION

The present invention relates to a water pressure booster system having a control valve which obviates the deficiencies of the aforementioned prior art devices. The system comprises a motor driven pump connected to a water supply source, an accumulator tank, a pressure switch responsive to water pressure in the system for turning the pump motor on and off, a control valve connected between the accumulator and pump, and a service outlet valve such as a faucet or the like.

The control valve regulates the water pressure in the system and also controls the refilling of the accumulator tank after the demand for water at the service outlet valve has closed. The valve is a closely balanced piston type, as opposed to the diaphragm valves of the prior art booster systems, and has an inlet connected to the pump and outlets connected to the accumulator tank, and to the system. The inlet from the pump is located between a throttle valve portion and a balance piston portion of a slidable valve member, such that the pump pressure forces on the valve member cancel each other out and do not tend to move the valve member in either direction. The balance piston portion has an orifice therethrough to allow passage of water past the piston into a chamber to produce a back pressure which tends to raise the valve member, thereby opening the throttle valve portion and allowing communication between the pump and the remainder of the system. The magnitude of the back pressure is determined by a miniaturized back pressure regulating device connected to the valve housing and remains at a relatively constant level.

The throttle valve portion is acted on by the system pressure which tends to close the throttle valve. Thus, it can be seen that the movement of the valve member is controlled solely by the differential between the system pressure and a relatively constant back pressure without the necessity of diaphragms, springs, or other biasing means.

The throttle valve portion contains a combination flow control/check valve which allows a small quantity of water to flow into the system after the system pressure has closed the throttle valve portion. This permits the pump and motor to keep running after the demand at the service outlet faucet has ceased so as to refill the accumulator tank. After the accumulator tank reaches a predetermined pressure, the pressure switch turns off the pump motor and the flow control/check valve closes to prevent backflow from the system to the pump.

It is an object of the present invention to provide a pressure booster system having a control vavle which regulates the pressure of water delivered within a narrow band and accomplishes such with low loss of pressure at high flow rates.

It is a further object to provide such a control valve which is capable of overcoming large frictional resistances as may be caused by foreign matter entering the valve or by accumulation of fouling within the valve.

Another object is to provide within said control valve, means to prevent backflow through the pump when the pump is not operating.

Additional objects are to provide a time delay so as to permit continued pump operation after cessation of demand; a control valve which is of compact design and low in cost; and a control valve which does not require the use of springs or diaphragms as direct biasing means.

BRIEF DESCRIPTION OF THE DRAWINGS

FIGS. 4–6 are sequential views showing, in cross-section, the operational positions of the valve of FIG. 2 during operation of the booster system of FIG. 1.

DETAILED DESCRIPTION OF THE PREFERRED EMBODIMENT

Figure 1:
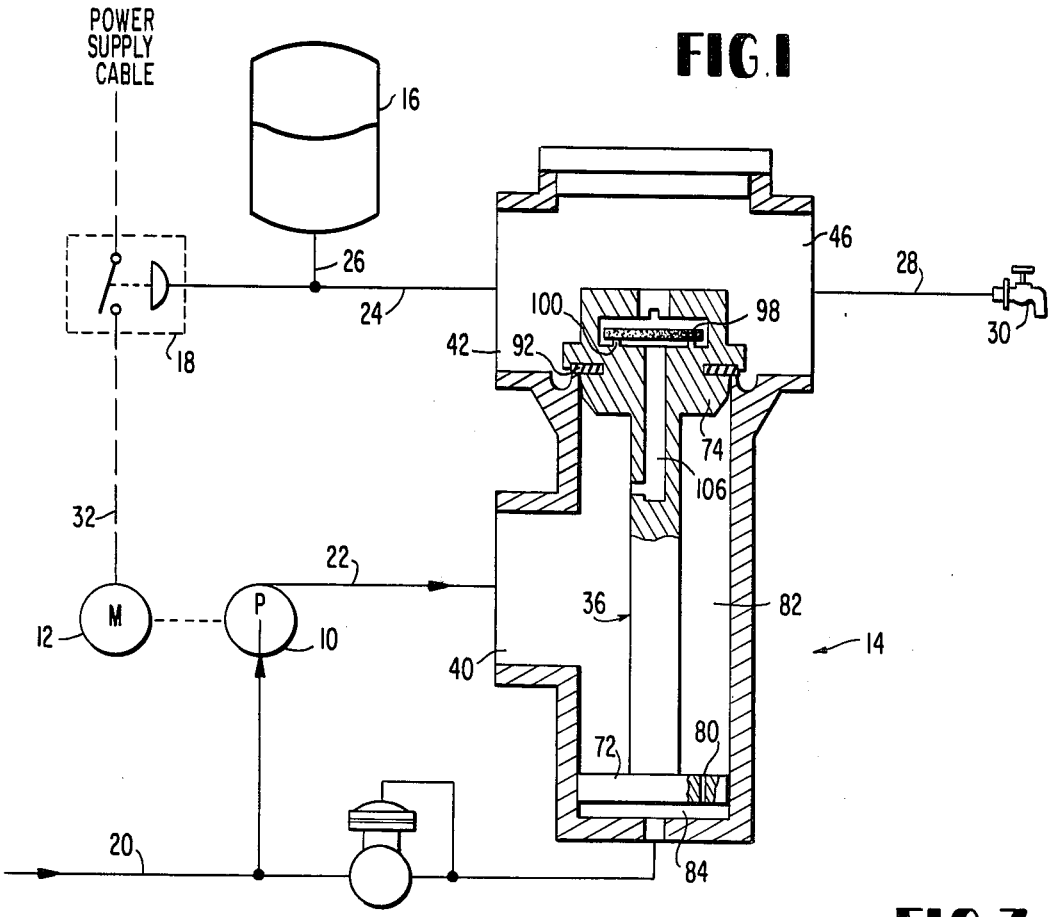
FIG. 1 is a schematic representation of a water pressure booster system according to the invention.

The water pressure booster system according to the invention is shown diagrammatically in FIG. 1 and comprises a water pump 10 driven by electric motor 12; control valve assembly 14; accumulator tank 16; and pressure actuated switch 18. Pump 10, which may be any type of pump suitable for a specific application (such as Gould shallow well pump Model JL07NS), has its inlet connected to a source of water which may be a well or municipal water supply system, via conduit 20. The outlet of pump 10 is connected to control valve assembly 14 via conduit 22. Control valve assembly 14 has a through passage connected on one side to accumulator 16 and pressure switch 18 by conduits 26 and 24 respectively, and on the other side to the building piping distribution system shown diagrammatically by conduit 28 and service outlet faucet 30. FIG. 1 is only a diagrammatic representation and any number of faucets and outlets may be provided throughout the building.

Accumulator 16 and pressure switch 18 are standard, commercially available items. Accumulator 16 may be Well-X-Trol Model WX-202 made by Amtrol Inc., while the pressure switch may be that incorporated in the aforementioned Gould pump, Model JL07NS. Obviously, any other items having similar functional characteristics may be used without exceeding the scope of this invention.

Motor 12 is connected to a source of electrical power via power supply cable 32 through pressure switch 18. If the location of the pressure booster system so permits electric motor 12 may be replaced by an internal combustion engine, or any other power source to drive pump 10.

Figure 2:
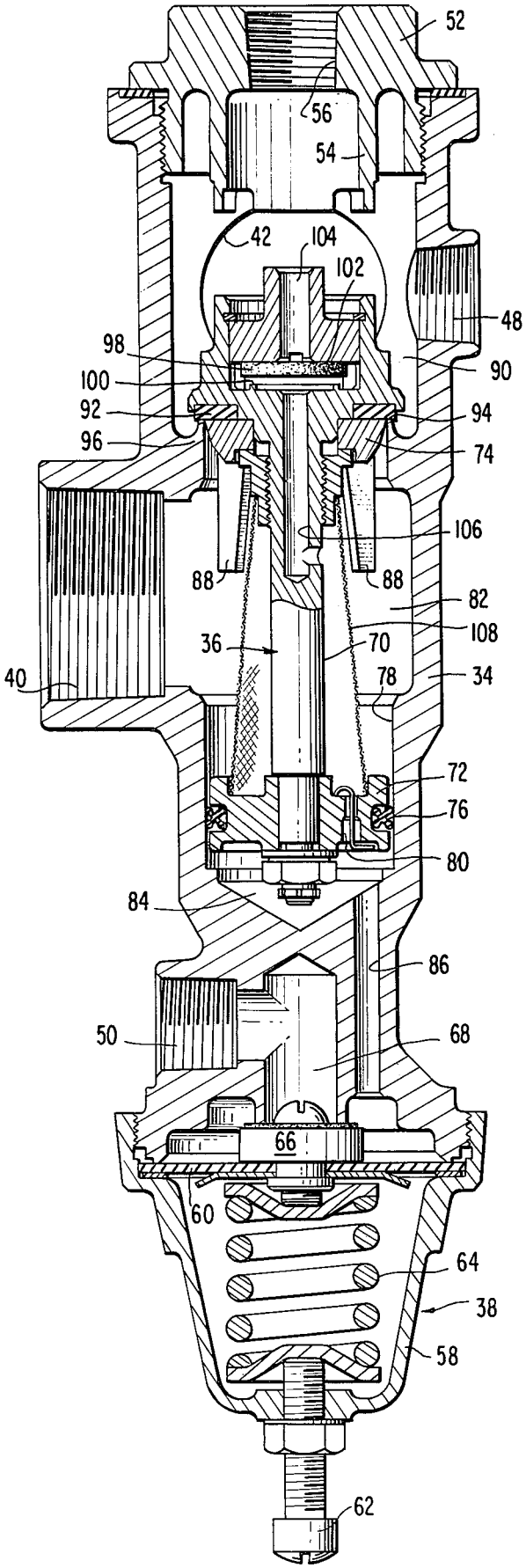
FIG. 2 is a cross-sectional view of the control valve of FIG. 1.

Control valve assembly 14 is shown in detail in FIG. 2 and comprises a housing 34, slidable valve member assembly 36 and back pressure regulator assembly 38. Housing 34 has inlet passage 40 connected to the outlet of pump 10 via standard threaded connections and conduit 22. A similar passage 42 is provided for connection to accumulator tank 16. Another passage 46 is provided, coaxially aligned with passage 42, to allow connection of control valve assembly 14 to the service outlet faucets 30. This passage extends perpendicularly from the plane of FIG. 2 and is shown schematically in FIG. 1. Housing 34 also has threaded passages 48 and 50 for connection to a pressure gage, and to the inlet conduit 20, respectively. Access plug 52 is threaded into the top of housing 34 to facilitate the installation and removal of valve member assembly 36. Access plug 52 has annular depending skirt 54 extending into housing 34 to limit the upward movement of valve member assembly 36. Passage 56 may be provided in access plug 52 to connect pressure switch 18 with a source of line pressure.

The lower portion of housing 34 is connected to back pressure regulator assembly 38. Regulator assembly 38 may be attached directly to housing 34, as shown in FIG. 2, or may be separate therefrom and be connected via a conduit. Regulator assembly 38 may also be a standard, off-the-shelf item such as Cash - Acme Model A-31R. Generally, regulator assembly 38 comprises a housing 58, which may be threadingly engaged with housing 34; a diaphragm 60 which extends across and seals the open end of housing 58; screw 62 threadingly engaging housing 58; and spring 64 which extends between screw 62 and diaphragm 60, normally biasing sealing member 66, attached to diaphragm 60, against the bottom of housing 34 thereby sealing off passage 68. As can be seen, passage 68 communicates with aforedescribed passage 50.

Valve member assembly 36 has central shaft 70 with balance piston 72 on its lower end, and throttle valve 74 on its upper end. Balance piston 72 has peripheral sealing means 76 to effect a seal between it and the inner surface 78 of housing 34. Orifice 80 is provided through balance piston 72 to allow fluid communication between central chamber 82 and lower chamber 84 within housing 34. Orifice 80 has a cross-sectional area of approximately 0.001 to 0.005 sq. in. Lower chamber 84 also communicates with back pressure regulator assembly 38 via passage 86.

Figure 3:
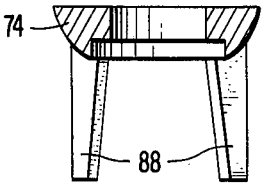
FIG. 3 is an enlarged cross-sectional view of an alternative embodiment of the throttle valve of FIG. 2.

Throttle valve 74 has a plurality of longitudinal valve guides 88 circumferentially displaced about its periphery. The guides 88 keep the longitudinal centerline of valve member assembly 36 coincident with the centerline of housing 34 during upward and downward movement of the valve member assembly. The outer surface of throttle valve 74 is shaped such that it throttles the flow of fluid between central chamber 82 and upper chamber 90. This may be achieved by forming the outer surface in the shape of truncated cones having increasing side angles, as shown in FIG. 2, or by forming the outer surface in the shape of a truncated paraboloid, as shown in FIG. 3. In either case, the rate of flow between central chamber 82 and upper chamber 90 will increase as valve member assembly 36 moves upwardly.

When valve member assembly 36 is in its lowermost position, as shown in FIG. 2, fluid communication between central chamber 82 and upper chamber 90 is normally prevented by sealing member 92, attached to valve member assembly 36, bearing against valve seat 94 defined by the upper surface of cylindrical inner projection 96 of housing 34.

The upper portion of valve member assembly 36 also contains flow control/check valve 98. Valve 98 is free to move between lower valve seat 100 and upper valve seat 102, depending upon the pressure differential between central chamber 82 and upper chamber 90. When the pressure in upper chamber 90 is greater than that in central chamber 82, flow control/check valve 98 will be pushed downwardly onto seat 100. If the pressure in central chamber 82 exceeds that in upper chamber 90, valve 98 will be pushed upwardly and engage valve seat 102. Valve seat 102 has at least one, and preferably a plurality of radial grooves emanating from the opening of passage 104 and extending to the outer circumference of seat 102 such that it allows passage of fluid even when check valve 98 engages seat 102. If two grooves are used, a width of 0.080 to 0.200 and a depth of 0.040 to 0.080 have been found sufficient to provide a flow rate of approximately 0.5 to 1.0 GPM from the pump into the system through this valve. The flow control/- check valve 98 is made of resilient material having a durometer of 40 to 70. Fluid will pass from central chamber 82, through passage 106, around the periphery of check valve 98, through the radial grooves, and into passage 104. The purpose of allowing passage of fluid past check valve 98 when in this position will be described hereinafter.

When check valve 98 engages valve seat 100, flow past the check valve between upper chamber 90 and central chamber 82 is prevented.

Screen 108 may be provided between the throttle valve portion and balance piston 72 to prevent dirt and other foreign matter from clogging or blocking the various passages in valve member assembly 36.

The operation of the system and the control valve will be described with particular reference to FIGS. 4–6. As starting conditions, it will be assumed that service outlet faucet 30 is closed, motor 12 and pump 10 are off, accumulator 16 is filled to capacity, and that valve member assembly 36 and check valve 98 are in the positions shown in FIG. 4. Once service outlet faucet 30 is opened, the requisite water is initially supplied from the water in the piping system and that in accumulator 16. If the demand is sufficiently great, the pressure in conduits 24, 26 and 28 drops to the set point of pressure switch 18. At this point, pressure switch 18 completes the circuit and turns on motor 12 and pump 10. The output from pump 10 enters control valve assembly 14 through passage 40. The diameters of balance piston 72 and throttle valve 74 are equal, therefore the pressure of fluid entering passage 40 does not move valve member assembly 36 in either direction.

The fluid passes through orifice 80 into lower chamber 84 and passage 86. It is prevented from proceeding further since sealing member 66 is blocking passage 68. Thus, fluid pressure builds up on the lower side of balance piston 72. This pressure builds up to a predetermined level, whereupon the force acting on diaphragm 60 overcomes the force exerted thereon by spring 64. Sealing member 66 opens passage 68 allowing fluid to pass therethrough and back into pump inlet conduit 20. Thus, pressure regulator assembly 38 controls the pressure level acting on the lower side of balance piston 72. This pressure can be manually adjusted by turning screw 62 and is typically adjusted to approximately midway between the cut in and cut out pressure of pressure switch 18 (i.e. 40–50 psig.)

Once this pilot pressure acting on the lower side of balance piston 72 exceeds the system pressure present in upper chamber 90, valve member assembly 36 will move upwardly, unseating sealing member 92. Flow control/check valve 98 will also move upwardly as shown in FIG. 5, when pressure in central chamber 82 exceeds the system pressure. Fluid passing between central chamber 82 and upper chamber 90 is throttled by throttle valve 74 as previously described. The position of throttle valve 74 with respect to seat 94 and the consequent amount of throttling is determined by the pressure differential between upper chamber 90 and lower chamber 84.

The valve member assembly 36 continues to control the flow of fluid into the system as long as service outlet faucet 30 is open. Once faucet 30 is closed, the pressure in the piping system will gradually build up to a point where it exceeds the pilot pressure acting on balance piston 72. At this point, valve member assembly 36 will move downwardly. It should be noted that the rate of increase of the pressure in the piping system and accumulator will diminish as throttle valve 74 approaches seat 94 due to its increased throttling of the fluid flow into upper chamber 90. This permits the motor 12 and pump 10 to run for longer periods of time and prevents the deleterious on-off cycling of the motor and pump.

The pressure in upper chamber 90 (and in the piping system) will gradually increase to a point where it will close throttle valve 74 completely, as shown in FIG. 6. At this point, the pressure in central chamber 82 is greater than that in upper chamber 90, thereby keeping flow control/check valve 98 in its upper position wherein it allows fluid flow, as previously described. The fluid flowing past check valve 98 and into upper chamber 90 serves to refill accumulator 16. The resiliency of flow control/check valve 98 serves to maintain the filling time of the accumulator relatively constant, regardless of the differential between the pump pressure and system pressure. The greater the pressure differential the more the valve 98 will deform into the aforementioned radial grooves so as to prevent increased flow therethrough caused by the greater pressure differential.

Once the accumulator 16 is refilled the pressure in the piping systems reaches the cut-off level of pressure switch 18 which turns off motor 12 and pump 10. Check valve 98 then contacts seat 100 to prevent backflow from upper chamber 90 into central chamber 82. The system is then in the position of FIG. 4 and ready to begin another cycle.

Figure 7:
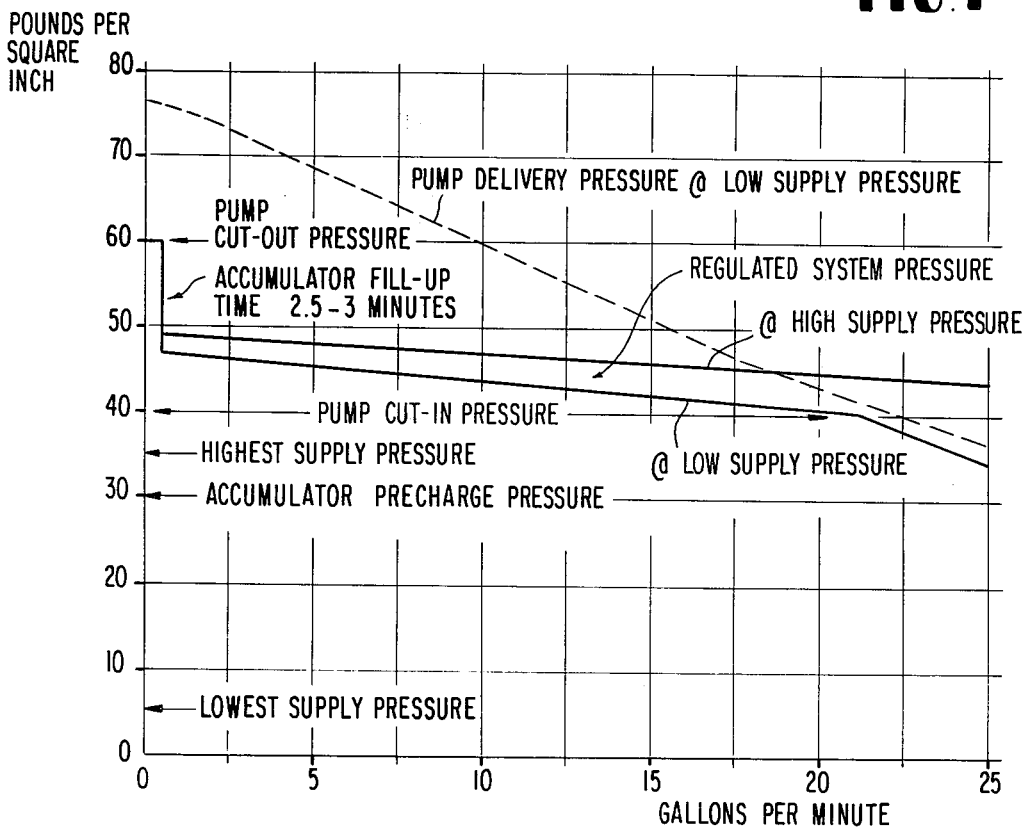
FIG. 7 is a graph of the operational characteristics of the water pressure booster system of FIG. 1.

Results of a test of a typical valve are shown in FIG. 7. For this test the pump cut in was set at 40 psig and pump cut-off was set at 60 psig. The pilot pressure varies with pump pressure and ranged from 40 to 50 psig. Pump discharge was 70–100 psig at low flow and 40–70 psig at high flow. Typical flows through throttle valve 74 arranged from 1–20 GPM, while flows through check valve 98 and orifice 80 were 0.5–1.0 GPM.

We claim:

1. In a water pressure booster system for regulating water pressure in a piping system having pumping means connected to a water supply, the improved means for controlling water flow into the piping system comprising:
   (a) a housing having an inlet passage connected to an outlet of said pumping means and an outlet connected said piping system;
   (b) a valve member contained within said housing without biasing means so as to be freely slidable therein, said valve member comprising a throttle valve, and a balance piston connected to said throttle valve, said balance piston having an orifice therethrough to allow passage of water from a first side of said piston to a second side;
   (c) combination flow control/check valve means disposed in a passage bypassing said throttle valve to permit a reduced flow of water into said piping system when said throttle valve is closed and said pumping means is operating and preventing flow from said piping system back through said passage when said pumping means stops; and
   (d) pressure regulating means to regulate the pressure acting on said second side of said balance piston, said pressure regulating means being interconnected between said second side of said piston and an inlet of said pumping means.

2. The improved water pressure booster system of claim 1 wherein said orifice has a cross-sectional area of between 0.001 and 0.005 square inches.

3. The improved water pressure booster system of claim 1 wherein said pressure regulating means is attached to said housing.

4. The improved water pressure booster system of claim 1 wherein said combination flow control/check valve means is located within said throttle valve.

5. The improved water pressure booster system of claim 1 wherein said combination flow control/check valve means comprises:

(a) a first annular valve seat (b) a second annular valve seat having at least one groove therein to allow passage of water from said pump means into said piping system; and (c) a resilient valve member movable between contact with said first valve seat, wherein it prevents fluid flow from said piping system into second valve seat wherein it allows a relatively small flow of water from said pump means into said piping system.

6. The improved water pressure booster system of claim 1 wherein said throttle valve modulates the pressure drop between said pump means and said piping system in response to the water flow demand in said piping system.

7. The improved water pressure booster system of claim 6 wherein said throttle valve has an outer surface in the shape of a truncated cone.

8. The improved water pressure booster system of claim 6 wherein said throttle valve has an outer surface in the shape of a truncated paraboloid.

9. The improved water pressure booster system of claim 1 wherein a central shaft connects said throttle valve and said balance piston, said central shaft having said bypass therethrough allowing fluid communication between said pump means and said first annular valve seat.

10. The improved water pressure booster system of claim 9 further comprising a fine mesh screen surrounding said central shaft between said throttle valve and said balance piston so as to prevent clogging or blocking of said orifice and said passage in said central shaft.

11. The improved water pressure booster system of claim 1 further comprising an accumulator tank connected to said piping system.

12. The improved water pressure booster system of claim 11 further comprising pressure switch means connected to said piping system such that when the pressure in said system decreases to a predetermined lower level said pressure switch means activates said pump means, and when the pressure in said piping system reaches a predetermined higher level, said pressure switch means deactivates said pump means.

13. The improved water pressure booster system of claim 1 wherein said valve member is located in said housing such that said inlet passage is intermediate said throttle valve and said balance piston.

14. The improved water pressure booster system of claim 13 wherein the diameter of said throttle valve is equal to that of said balance piston such that the force exerted on said valve member by the water entering the housing does not move said valve member.

15. A method of regulating the water pressure in a piping system having a water pressure booster pump and a control valve of the balance piston type comprising the steps of:

(a) directing water into said control valve intermediate a throttling valve and a balance piston attached thereto such that the forces generated by the water pressure on said throttling valve do not open or close same;

(b) establishing a relatively constant, regulated pressure on one side of said balance piston;

(c) applying piping system pressure to said throttle valve in opposition to the pressure acting on said balance piston such that the opening and closing of said throttle valve is dependent upon the pressure differential between said regulated pressure and said piping system pressure; and (d) venting said regulated pressure to the suction side of the booster pump.

16. The method of claim 15 comprising the additional step of throttling the fluid flow from the pump into said system, wherein the amount of throttling is inversely proportional to the distance between said throttling valve and its seat.

17. A valve comprising:

(a) a housing having an inlet passage and an outlet passage;

(b) a valve member contained within said housing without biasing means so as to be freely slidable therein, said valve member having a central shaft with a throttle valve portion on a first end of said central shaft and a balance piston on a second end, said valve member located such that said inlet passage is intermediate said throttle valve and said balance piston;

(c) means for establishing a regulated pressure acting on said balance piston such that the movement of the slidable valve member is controlled by the pressure differential between the regulated pressure and a pressure at the outlet passage; and (d) flow control/check valve means located in said throttle valve portion and controlling fluid flow between said inlet passage and said outlet passage when said throttle valve portion is closed, said flow control/check valve means allowing fluid flow when said inlet pressure is greater than said outlet pressure and preventing fluid flow when the outlet pressure exceeds the inlet pressure.

18. The valve of claim 17 wherein the balance piston has orifice or channel therethrough to allow passage of fluid from a first, inlet side to a second side of said balance piston.

19. The valve of claim 17 further comprising pressure regulating means connected to said housing to regulate the pressure acting on said second side of said balance piston.

20. The valve of claim 18 wherein the throttle valve portion has an outer surface in the shape of a compound truncated cone such that the amount of fluid throttling is inversely proportional to the distance between said throttling valve and its seat.

21. The valve of claim 18 wherein the throttle valve portion has an outer surface in the shape of a truncated paraboloid such that the amount of fluid throttling is inversely proportional to the distance between said throttling valve and its seat.

* * * * *